US006791519B2

(12) United States Patent
Aarts et al.

(10) Patent No.: US 6,791,519 B2
(45) Date of Patent: Sep. 14, 2004

(54) SOUND AND VISION SYSTEM

(75) Inventors: Ronaldus Maria Aarts, Eindhoven (NL); Mark Thomas Johnson, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 249 days.

(21) Appl. No.: 10/080,159

(22) Filed: Feb. 20, 2002

(65) Prior Publication Data

US 2002/0171636 A1 Nov. 21, 2002

(30) Foreign Application Priority Data

Apr. 4, 2001 (EP) ..... 01201292

(51) Int. Cl.[7] ..... G09G 3/36

(52) U.S. Cl. ..... 345/87; 345/75.2; 345/76; 345/107; 381/173; 381/306

(58) Field of Search ..... 345/44, 49, 50, 345/60, 75.2, 76, 80, 87, 105, 107, 177; 381/306, 173; 181/210; 348/198, 744; 359/311, 312

(56) References Cited

U.S. PATENT DOCUMENTS

| | | | | | |
|---|---|---|---|---|---|
| 4,233,472 | A | | 11/1980 | Kleis | 179/1 GA |
| 5,400,414 | A | * | 3/1995 | Thiele | 381/190 |
| 6,137,890 | A | | 10/2000 | Markow | 381/330 |
| 6,177,767 | B1 | | 1/2001 | Asai et al. | 315/169.1 |
| 6,342,831 | B1 | * | 1/2002 | Azima | 340/384.1 |
| 6,373,461 | B1 | * | 4/2002 | Hasegawa et al. | 345/107 |
| 6,389,935 | B1 | * | 5/2002 | Azima et al. | 81/388 |
| 6,427,017 | B1 | * | 7/2002 | Toki | 381/190 |
| 6,477,256 | B1 | * | 11/2002 | Stoehr | 381/306 |
| 2003/0059069 | A1 | * | 3/2003 | Bank et al. | 381/152 |

FOREIGN PATENT DOCUMENTS

| | | | |
|---|---|---|---|
| EP | 0269150 A1 | 6/1988 | G09G/3/36 |
| EP | 0814366 A2 | 12/1997 | G02F/1/137 |
| WO | WO0002417 | 1/2000 | H04R/7/06 |
| WO | WO0038163 | 6/2000 | G09G/3/34 |
| WO | WO0069212 | 11/2000 | H04R/1/02 |

* cited by examiner

*Primary Examiner*—Henry N. Tran
(74) *Attorney, Agent, or Firm*—Edward W. Goodman

(57) ABSTRACT

A sound and vision system includes a display device (1) and an acoustic transducer, such as a loudspeaker or a microphone. The display device includes display cells (9) having opposite electrodes (7, 8) and includes a conductive line (11) connected to the electrodes in order to address the display cells. The acoustic transducer is formed by the display cell itself and the conductive line is electrically coupled to the display cell/acoustic transducer in order to convey signals, as a result of which the acoustic transducer is an integral part of the display device.

17 Claims, 4 Drawing Sheets

SOUND AND VISION SYSTEM

BACKGROUND OF THE INVENTION

1. Field of the Invention

The invention relates to a sound and vision system comprising a display device and an acoustic transducer means.

The invention further relates to an electronic apparatus including such a system.

2. Description of the Related Art

International Patent Application No. WO-A/00/69212 discloses a small portable electronic article for personal use, such as a personal organizer or a mobile telephone, this article having a case provided with a keyboard or keypad, a visual display and a transparent cover over the display. The electronic article further comprises a loudspeaker composed of the transparent cover and a vibration exciter mounted on the transparent cover, the transparent cover thus serving as an acoustic radiator. Although the loudspeaker is incorporated in the known small personal portable electronics article in order to reduce weight and volume of the article, the possibilities to reduce, e.g., weight and volume seem to be not fully exploited.

SUMMARY OF THE INVENTION

It is an object of the invention to provide a sound and vision system in which the acoustic transducer means is further integrated in the system.

This object is achieved by the sound and vision system according to the invention, comprising a display device and acoustic transducer means, the display device including display cells having opposite electrodes, and conductive means connected to the electrodes in order to address said display cells, wherein the acoustic transducer means includes one or more of said display cells and the conductive means is electrically coupled to the acoustic transducer means. It is known that a display comprises a display electronic means for selecting and controlling the display cells, the display electronic means including said conductive means and the display cells of the display device incorporating electro-optical devices. In the sound and vision system according to the invention, the acoustic transducer means is virtually an integral part of the display device, the display electronic means, particularly its conductive means, being used for making an electrical connection to the acoustic transducer means for transmission of electrical signals to and/or from the acoustic transducer means.

The invention is based on the insight that it is possible to provide a sound and vision system with an acoustic transducer means by only or mainly making use of components already present in a known display device, without any significant loss of performance of the vision function itself. By means of this invention, which is the result of this insight, the number of components is reduced as compared with the known article, and further miniaturization of sound and vision systems is achieved. In general, the frequencies typically used to display visual data on a display screen only include low frequencies, particularly, the 50–60 Hz frame refresh rate, and very high frequencies, particularly, the data rate beyond 100 kHz. These frequency ranges fall outside the acoustic band normally used for speech audio of, e.g., a telephone, particularly, 300 Hz–3400 Hz, and practically fall outside the range of high performance audio, particularly, up to 20 kHz. Thus, a video addressing does not produce any undesired audio output, while, on the other hand, the display cells can be excited at intermediate audio frequencies without interfering with the video signals. It is to be noted that it is conceivable to use only the sound function of the system according to this invention.

An embodiment of the sound and vision system according to the invention is characterized in that the display device is a liquid crystal display device including a liquid crystal layer sandwiched between substrates. Especially liquid crystal materials —and effects—which exert a strong mechanical force on the substrate are useful. Suitable examples of such materials are (anti)ferro electric liquid crystals, flexo electric liquid crystals and cholesteric texture liquid crystels. A prior art liquid crystal display device is disclosed in U.S. Pat. No. 4,723,838 (herewith incorporated by reference).

An embodiment of the system according to the invention is characterized in that the display device is an electrochromic display device including a material of which the color is switchable in dependence on an electric current or potential.

An embodiment of the system according to the invention is characterized in that the display device is an electrophoretic display device including an electrophoretic display medium sandwiched between conductors. A prior art electrophoretic display device is disclosed in the article 44.3L: A Printed and Rollable Bistable Electronic Display, P. Drzaic, et al.; SID98 Digest, pages 1131–1134; 1998 (herewith incorporated by reference).

An embodiment of the system according to the invention is characterized in that the display device is a reflective display device including an interferometric modulator. A prior art reflective display device is disclosed in the article 5.3: Digital Paper TM: Reflective Displays Using Interferometric Modulation, M. W. Miles; SID00 Digest, pages 32–35; 2000 (herewith incorporated by reference).

An embodiment of the system according to the invention is characterized in that the display device is a luminescent display device. A prior art luminescent display device is disclosed in U.S. Pat. No. 6,177,767 (herewith incorporated by reference). An embodiment of the system is characterized in that the electroluminescent display device includes an organic light-emitting device.

An embodiment of the system according to the invention is characterized in that the display device is a field emission display device. A prior art field emission display device is disclosed in article L2.1: Late-News Paper: A.4.5-in. Fully Sealed Carbon nanotube-Based Field-Emission Flat-Panel Display, W. B. Choi et al.; SID 99 Digest, pages 1134–1137 (herewith incorporated by reference).

An embodiment of the system according to the invention is characterized in that the display device is a foil display device. A prior art foil display device is disclosed in International Patent Application No. WO 00/38163 (herewith incorporated by reference).

An embodiment of the system according to the invention is characterized in that the display device is a plasma display device. A prior art plasma display device is disclosed in the paper ISSN 1083–1312/97/1701–0281; 1997 SID; Fabrication Techniques for High-Resolution 42-Inch HDTV PDP, M. Seki et al. (herewith incorporated by reference).

An embodiment of the system according to the invention is characterized in that the display device is a plasma-addressed liquid crystal display device. Such a device employs, with plasma display and liquid crystal display technologies, a display cell of the liquid crystal display device having with a physical electrode and a virtual electrode. The virtual electrode is formed by a charge layer produced by the plasma during operation. In this embodiment, the conduction means is connected, particularly electrically connected, to the virtual electrodes via the plasma. A prior art plasma-addressed liquid crystal display device is disclosed in the article 20.4L: Late-News Paper: Development of a 42-in. High-Definition Plasma-Addressed LCD, M. Hoyashi et al.; SID 99 Digest, pages 280–283 (herewith incorporated by reference).

An embodiment of the system according to the invention is characterized in that the acoustic transducer means is a loudspeaker, wherein, a vibration of a display cell is generated during use, by an electrostatic force produced by a voltage difference across the opposite electrodes of said cell. The loudspeaker includes or can be connected to an electric driving means, particularly a voltage source. By varying the voltage across opposite electrodes, a varying electrostatic force is generated for radiating sound from the display device, said force varying in a manner related to the varying voltage.

An embodiment of the system according to the invention, in which the acoustic transducer means is a loudspeaker, has a control means for selectively driving display cells. By selectively driving a number or all of the display cells, the display device can be used as a 2D loudspeaker array, offering the possibility to direct a beam of sound generated by such an array and to control the acoustic directivity. It is possible to generate a narrow beam of sound, e.g., radiated in a main beam directly into an ear. Alternatively, it is possible to divide the array in sub-arrays, each producing the sound of a particular sound channel, e.g., a left and a right channel, such that stereophonic sounds may be reproduced. The last-mentioned feature may be combined with technologies, such as, sound-base widening techniques. In other words, this embodiment enables the creation of complex acoustic patterns to either focus the sound or to expand the sound image. It is to be noted that such a control means is known per se. U.S. Pat. No. 4,233,472 (herewith incorporated by reference), e.g., discloses a circuit arrangement for a loudspeaker combination, the combination comprising a plurality of dynamic speakers which are arranged adjacent to each other in a continuous plane. The speakers may be arranged in line or in a two-dimensional configuration, the directivity pattern of the loudspeaker combination being determined by the circuit arrangement. Such an arrangement may be used as control means in the system according to the invention.

An embodiment of the system according to the invention is characterized in that the acoustic transducer means is a microphone, wherein, during use, a vibration of a display cell generates a voltage difference across the opposite electrodes of said cell. The acoustic transducer means can be a combination of a loudspeaker and a microphone.

It is to be noted further that U.S. Pat. No. 6,137,890 discloses a portable computer piezoelectric speaker, wherein a lid of a computer device serves as a rear speaker panel and a display screen of the computer device serves as a front speaker panel and wherein a piezoelectric actuator is located at or near the middle of a speaker panel for bringing the panel into vibration in order to radiate sound.

The electronic apparatus according to the invention, which apparatus may be a portable small apparatus, such as a mobile telephone, or a large apparatus, such as a TV set or a monitor, includes the sound and vision system according to the invention.

The above-mentioned and other aspects of the invention are apparent from and will be elucidated, by way of non-limitative example, with reference to the embodiments described hereinafter.

DESCRIPTION OF THE PREFERRED EMBODIMENTS

Figure 1:
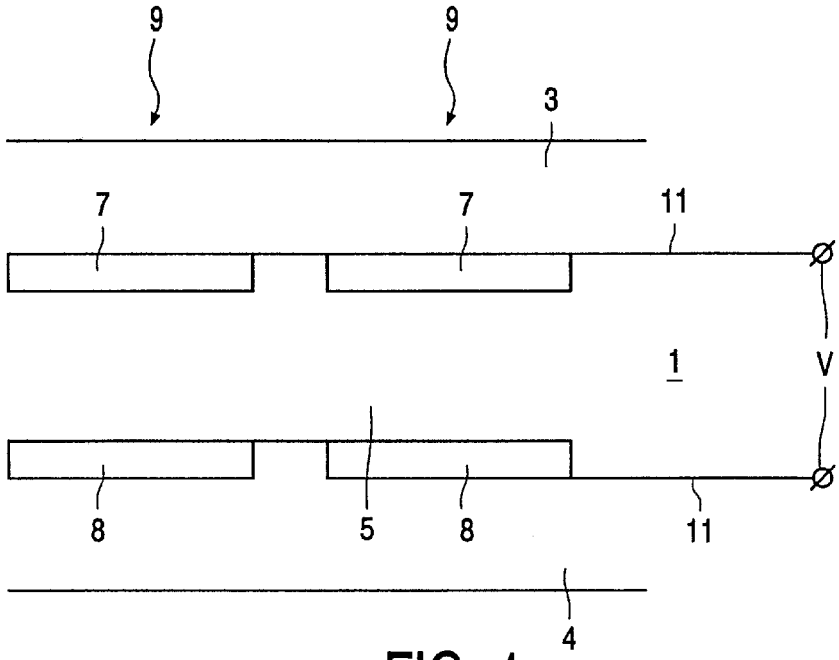
FIGS. 1 to 9 diagrammatically show several embodiments of the sound and vision system according to the invention.

An embodiment of the sound and vision system according to the invention, as shown in FIG. 1, comprises a liquid crystal display device 1 incorporating an acoustic transducer means, particularly a loudspeaker. The liquid crystal display device 1 comprises a pair of substrates 3, 4 of glass or the like facing each other, a layer 5 of a liquid crystal material being present between the substrates 3, 4. A plurality of electrodes 7 consisting of a transparent conductive film are formed on an inner surface of the transparent substrate 3. The other surface of the substrate 3 may form the front of the device. Electrodes 8 are present on an inner surface of the other substrate 4, such that the electrodes 8 face the electrodes 7. The electrodes 8 may form a common electrode. Two facing electrodes 7, 8 together with the liquid crystal material therebetween form a display cell 9. The display device 1 further comprises a conductive means 11 including conductive tracks and switching means, e.g., thin film transistors, for addressing the display cells 9. The loudspeaker is formed by all or a number of the display cells 9, the conductive means 11 being electrically coupled to the relevant electrodes 7, 8 to apply voltages V across said electrodes in order to cause the display cells 9 to vibrate and create an acoustic output. Such a vibration is generated by electrostatic forces working across the layer 5 of liquid crystal material. The frequency and magnitude of the acoustic output is tunable in frequency and amplitude, depending on the values of the voltages applied. It is to be noted that a number of facing electrodes may be applied to the same substrate in the so-called in-plane switching LCD.

Figure 2:
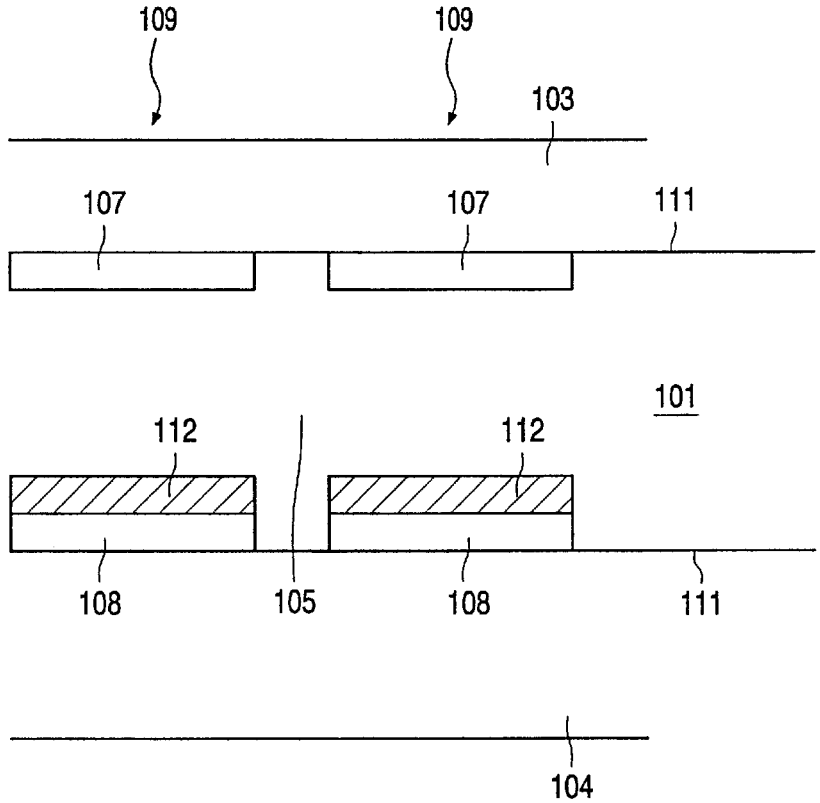

Another embodiment of the system according to the invention, as shown in FIG. 2, comprises an electrochromic display device 101. The device 101 comprises two substrates 103 and 104, each carrying electrodes 107 and 108, respectively. An electrochromic conducting polymer layer 112 is provided on the electrodes 108 and is in contact with an electrolyte layer 105. The layer 105 may contain a solid electrolyte or, alternatively, a liquid electrolyte. Two facing electrodes 107, 108 together with the electrolyteically conductive material of the electrolyte layer 105 and the electrochromically conducting material of the layer 112 form a display cell 109. One or several of these cells 109 form an acoustic transducer means, a conductive means 111 being electrically coupled to the acoustic transducer means for conveying signals. The transducer means may be a loudspeaker, in which case voltages are applied across one or more pairs of electrodes 107, 108 in order to generate a sound vibration of one or more display cells 109. Alternatively, the transducer means may be a microphone, in which case motions, caused by an incident sound pressure, of display cells generate changes in capacitance between facing electrodes and produce voltage differences across the relevant facing electrodes. The transducer means may even be a combination of a loudspeaker and a microphone.

Figure 3:
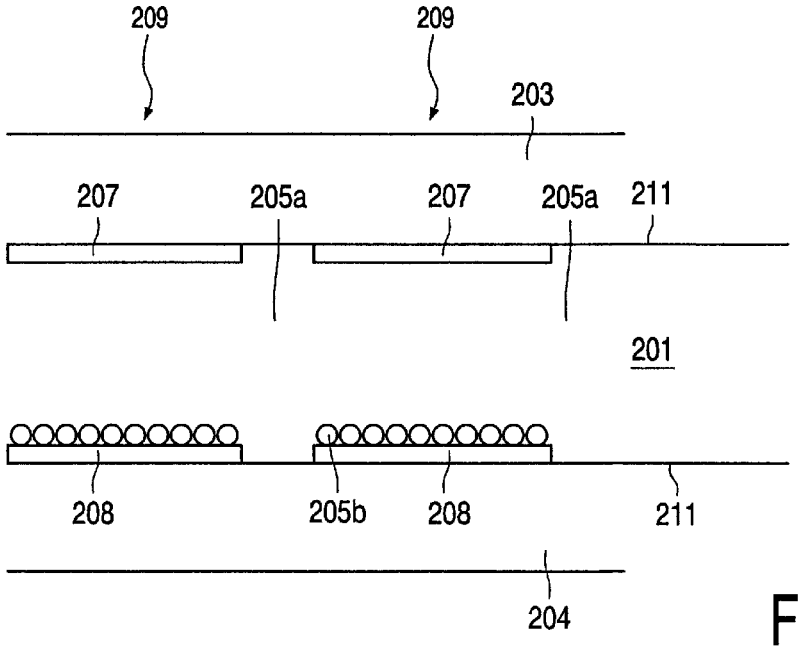

Another embodiment of the system in accordance with the invention, as shown in FIG. 3, comprises an elecrophoretic display device 201. The device 201 comprises two substrates 203 and 204 each carrying electrodes 207 and 208, respectively. A layer 205, including an electrophoretic display liquid 205*a* and particles 205*b*, is sandwiched between the substrates 203 and 204, and is in contact with the electrodes 207 and 208. A pair of facing electrodes 207, 208 together with the material of the electrophoretic layer 205 forms a display cell 209. One or more display cells 209 constitute an acoustic transducer means, such as a loudspeaker, a conductive means 211, such as conductive tracks, being provided for electrical coupling to the acoustic transducer means, particularly the electrodes 207, 208.

Figure 4:
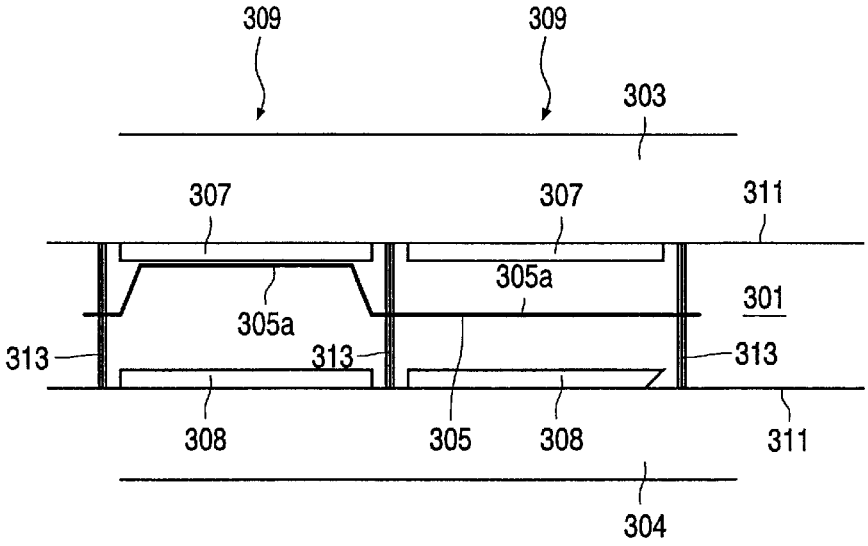

Another embodiment of the system in accordance with the invention, as shown in FIG. 4, comprises a reflective display device 301. The device 301 comprises two substrates 303 and 304, each carrying electrodes 307 and 308, respectively, these electrodes being electrically connected to a conductive means 311. An interferometric modulator including a foil 305 extends in a space between the substrates 303 and 304. The foil 305 is locally fixed to spacers 313 extending between the substrates 303 in order to form foil portions 305a. Each pair of facing electrodes 307, 308 together with a sandwiched portion 305*a* forms a display cell 309. Such a display cell forms or is part of an acoustic transducer means.

Figure 5:
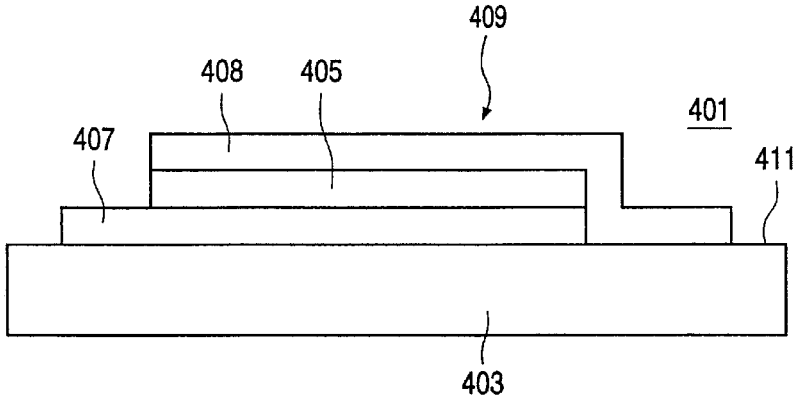

Another embodiment of the system in accordance with the invention, as shown in FIG. 5, comprises a luminescent, particularly an organic electroluminescent, display device 401. The device 401 comprises a substrate 403 carrying electrodes 407 and a conductive means 411 electrically connected to the electrodes 407. An electroluminescent layer 405 extends between the electrodes 407 and the opposite electrodes 408. Each pair of facing electrodes 407 and 408 together with the luminescent material of the layer 405 extending between these electrodes forms a display cell 409. One or more of these display cells form an acoustic transducer means.

Figure 6:
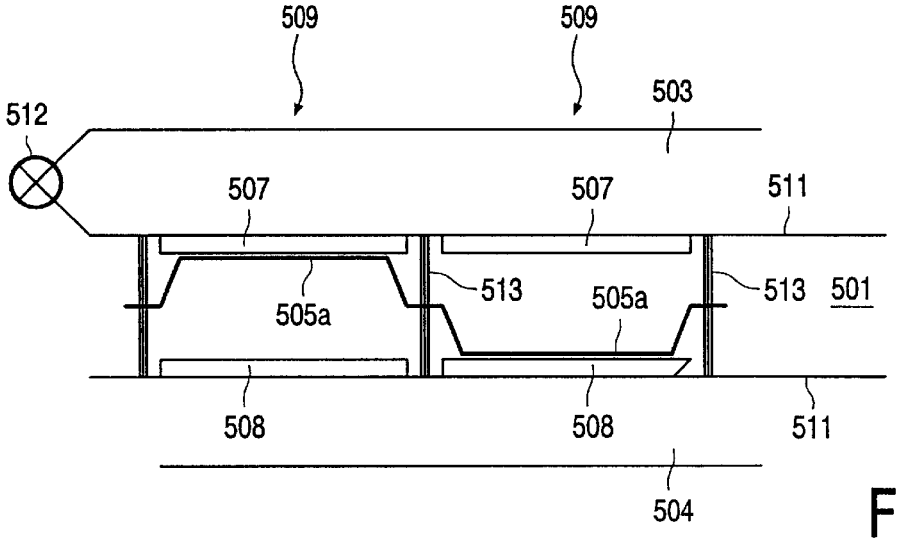

Another embodiment of the system in accordance with the invention, as shown in FIG. 6, comprises a foil display device 501 having two substrates 503 and 504 carrying electrodes 507 and 508, respectively, and a conductive means 511 electrically coupled to the electrodes 507 and 508. The substrate 503 is a light guide which can be illuminated by a light source 512. Spacer elements 513 are provided between the substrates 503 and 504. Membrane or foil portions 505*a* of a metallic material are present in a space between the substrates 503 and 504 and extend between and are fixed to the spacer elements 513. Each pair of facing electrodes 507, 508 together with the membrane portion 505*a* sandwiched therebetween forms a display cell 509 of an acoustic transducer means.

Figure 7:
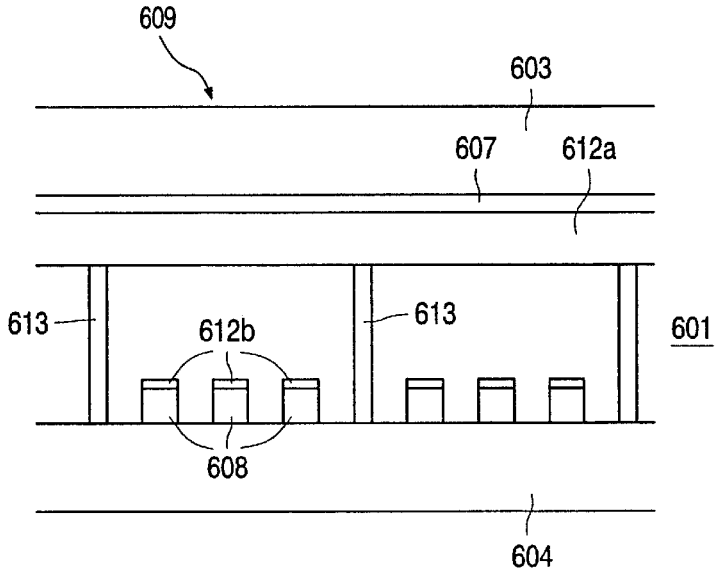

Another embodiment of the system according to the invention, as shown in FIG. 7, comprises a flat panel field-emission display 601. The device 601 includes two plate-shaped glass substrates 603 and 604, the substrates 603 and 604 carrying electrodes 607 and 608, respectively. The electrodes 607 and 608 carry a phosphor layer 612*a* and field emitters 612*b*, respectively. Spacers 613 are provided between the two substrates 603 and 604. Two facing electrodes 607 and 608 together with the phosphor layer 612*a* provided on the relevant electrode 607 and the field emitters 612*b* provided on the relevant electrode 608 form a display cell 609. One cell or a number of these cells constitute(s) an acoustic transducer means, such as a loudspeaker. The display device 601 further includes conductive means, not shown, electrically connected to the electrodes 607 and 608 for, on the one hand, addressing the display cells, and on the other hand, conveying signals relating to sound.

Figure 8:
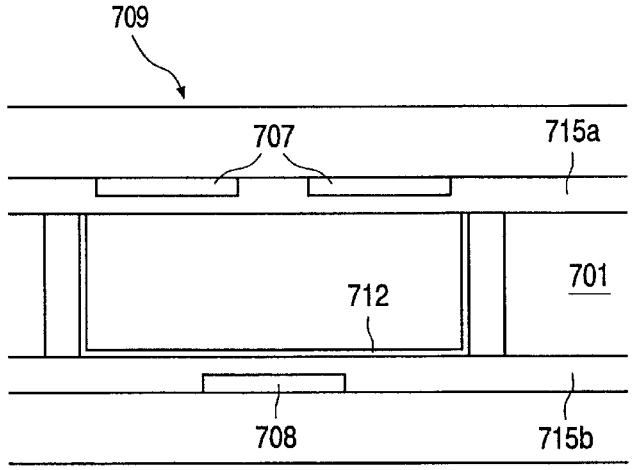

Another embodiment of the system according to the invention, as shown in FIG. 8, comprises a plasma display device 701 including display cells 709 and conductive means electrically connected to said cells. Such a display cell 709 has a display electrode 707 and an address electrode 708 both embedded in a dielectric layer 715*a* and 715*b*, respectively, and a barrier rib 713 extending between the two facing electrodes 707 and 708. A phosphor layer 712 is present in the interior of each cell 709. Each display cell 709 may form part of an acoustic transducer means.

Figure 9:
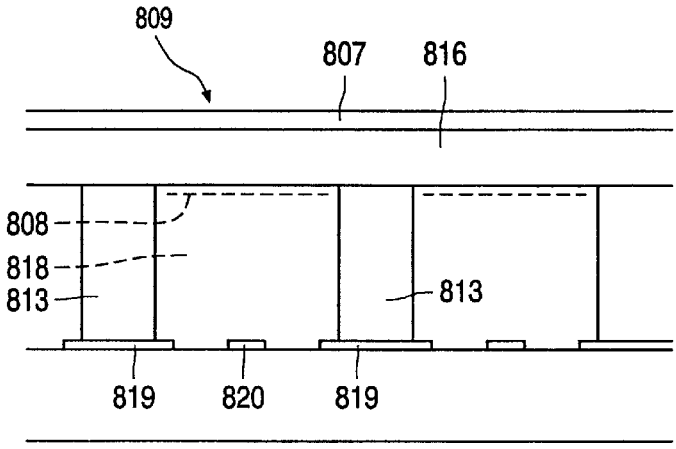

Another embodiment of the system according to the invention, as shown in FIG. 9, has a plasma-addressed liquid crystal display (LCD) device 801 and an acoustic transducer means, e.g., a loudspeaker, formed by display cells 809 of the device 801. A display cell 809 includes an electrode or electrode portion 807, a liquid crystal 816 and a virtual electrode 808 formed by a plasma 818 generated during operation of the device 801. Such a plasma is formed between ribs 813 by means of electrodes 819 and 820. As in the other embodiments, the device 801 is provided with a suitable conductive means for conveying signals relating to sound. In the case of a loudspeaker embodiment, the conductive means is at least electrically connected to the electrodes or electrode portions 809 in order to set display cells 809 into vibration or motion to radiate sound. It is within the scope of the invention to drive each cell 809 with an individual signal, i.e., voltage, in order to control the directivity of the bundle of radiated sound. Such a measure can also be applied to the other embodiments.

To apply this measure, the sound and vision system, preferably its display device, is preferably provided with electronic selection or control means, including suitable circuitry for selectively driving display cells.

Figure 10:
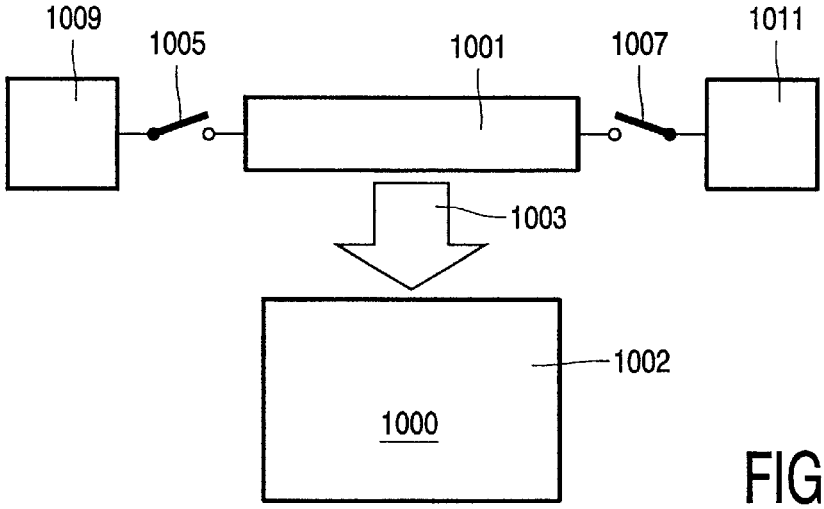
FIG. 10 is a block diagram relating to the sound and vision system according to the invention.

The block diagram shown in FIG. 10 schematically shows the operation of a loudspeaker embodiment of the sound and vision system in accordance with the invention. The system 1000 includes a display data driver 1001 for generating data which is transferred (arrow 1003) to appropriate sections, i.e., display cells, of a display device 1002. Switching means 1005, 1007 are included to supply the data driver 1001 with image information from an image data means 1009 and/or acoustic data from an acoustic data means 1011.

Figure 11:
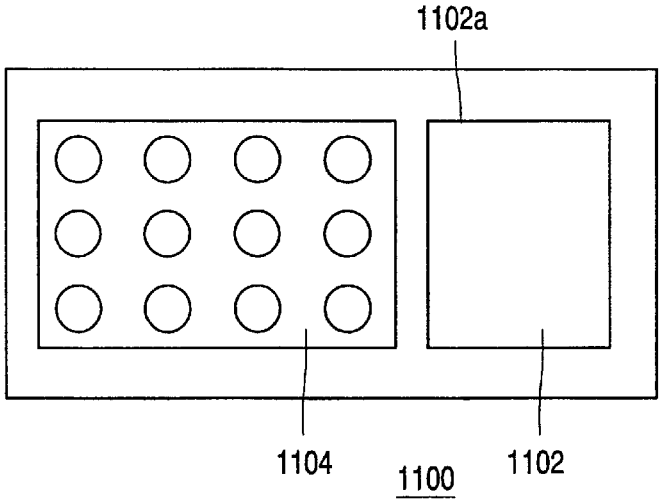
FIG. 11 diagrammatically shows an embodiment of the electronic apparatus according to the invention.

Another embodiment of the electronic apparatus in accordance with the invention, as shown in FIG. 11, is a portable telephone 1100, including an embodiment of the sound and vision system according to the invention. The telephone 1100 has a display device 1102 having a display screen 1102*a* which forms an acoustic transducer means. The display device 1102 is a part of the embodiment of the sound and vision system according to the invention. The telephone 1100 further has a keypad 1104. The acoustic transducer means of the display device 1102 may be a loudspeaker and/or a microphone.

It is to be noted that the invention is not restricted to the embodiments shown. Any embodiment having a transducing means formed by a display cell, wherein the conductive means of the display device is electrically coupled to the acoustic transducer means in order to convey signals to and/or from the transducing means, is regarded as being within the scope of the invention.

What is claimed is:

1. A sound and vision system comprising a display device and acoustic transducer means, said display device comprising display cells having opposite electrodes and conductive means connected to the electrodes for addressing said display cells, wherein the acoustic transducer means consists of one or more of said display cells, the conductive means being electrically coupled to the acoustic transducer means.

2. The sound and vision system as claimed in claim 1, wherein the display device is a liquid crystal display device having a liquid crystal layer sandwiched between substrates.

3. The sound and vision system as claimed in claim 2, wherein the liquid crystal layer comprises a liquid crystal material out of the group flexoelectric liquid crystals, cholestic liquid crystals and ferroelectric liquid crystals.

4. The sound and vision system as claimed in claim 1, wherein the display device is an electrochromic display device having a material having color that is switchable in dependence on an electric current or potential.

5. The sound and vision system as claimed in claim 1, wherein the display device is an electrophoretic display device having an electrophoretic display medium sandwiched between conductors.

6. The sound and vision system as claimed in claim 1, wherein the display device is a reflective display device having an interferometric modulator.

7. The sound and vision system as claimed in claim 1, wherein the display device is a luminescent display device.

8. The sound and vision system as claimed in claim 7, wherein the luminescent display device includes an organic light-emitting device.

9. The sound and vision system as claimed in claim 1, wherein the display device is a field-emission display device.

10. The sound and vision system as claimed in claim 1, wherein the display device is a foil display device.

11. The sound and vision system as claimed in claim 1, wherein the display device is a plasma display device.

12. The sound and vision system as claimed in claim 1, wherein the display device is a plasma-addressed liquid crystal display device.

13. The sound and vision system as claimed in claim 1, wherein the acoustic transducer means acts as a loudspeaker, a vibration of a display cell forming said acoustic transducer means being generated by an electrostatic force produced by a voltage difference across the opposite electrodes of said display cell.

14. The sound and vision system as claimed in claim 13, characterized in that said sound and vision system further comprises control means for selectively driving the display cells forming said acoustic transducer means in order to control the sound directivity.

15. The sound and vision system as claimed in claim 1, wherein the acoustic transducer means acts as a microphone, a vibration of a display cell forming the acoustic transducer means generating, a voltage difference across the opposite electrodes of said display cell, said voltage difference being conducted by said connecting means.

16. An electronic apparatus including the sound and vision system as claimed in claim 1.

17. A mobile telephone provided with the system as claimed in claim 1.

* * * * *